US007508404B2

(12) United States Patent
Henzel et al.

(10) Patent No.: US 7,508,404 B2
(45) Date of Patent: Mar. 24, 2009

(54) THERMAL PRINTER WITH TWO PRINT HEADS

(75) Inventors: Richard P. Henzel, Webster, NY (US); William Y. Fowlkes, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 101 days.

(21) Appl. No.: 11/643,272

(22) Filed: Dec. 21, 2006

(65) Prior Publication Data

US 2008/0153029 A1 Jun. 26, 2008

(51) Int. Cl.
*B41J 2/325* (2006.01)
*B41J 2/525* (2006.01)

(52) U.S. Cl. ..... 347/172

(58) Field of Classification Search ..... 347/171, 347/172, 173, 174, 176; 400/120.01, 120.02, 400/120.04

See application file for complete search history.

(56) References Cited

U.S. PATENT DOCUMENTS

| | | | |
|---|---|---|---|
| 4,638,331 | A | 1/1987 | Watanabe |
| 4,815,872 | A | 3/1989 | Nagashima |
| 5,157,413 | A | 10/1992 | Nagato et al. |
| 5,440,328 | A | 8/1995 | Nardone et al. |
| 5,611,629 | A | 3/1997 | Paranjpe |
| 5,739,835 | A | 4/1998 | Morgavi et al. |
| 5,798,783 | A | 8/1998 | Maslanka et al. |
| 5,838,357 | A | 11/1998 | Maslanka et al. |
| 5,841,460 | A | 11/1998 | Maslanka et al. |
| 6,573,923 | B2 | 6/2003 | Hevenor et al. |
| 6,908,239 | B1 | 6/2005 | Foster et al. |
| 2006/0158505 | A1 | 7/2006 | Jin |
| 2006/0171755 | A1 | 8/2006 | Clarke |

FOREIGN PATENT DOCUMENTS

| | | |
|---|---|---|
| JP | 61 112667 | 5/1986 |
| JP | 2003-145817 | 5/2003 |

*Primary Examiner*—Huan H Tran
(74) *Attorney, Agent, or Firm*—Stephen H. Shaw

(57) ABSTRACT

A thermal printers and printing methods are provided. The thermal printer has a first thermal print head adapted to pressure a first donor web against the receiver medium and to selectively transfer donor material to the receiver medium in an image wise fashion to form a first image in an image receiving area of the receiver medium; and a second thermal print head adapted to pressure a second donor web against the receiver medium and to selectively transfer second donor material to the receiver medium in an image wise fashion to form a second image in the image receiving area. A receiver medium transport system moves receiver medium along a printing path and the first thermal print head and the second thermal print head are positioned along the path so that they can apply donor material to the receiver medium at least in part simultaneously when instructed by a controller.

15 Claims, 3 Drawing Sheets

| STEP | |
|---|---|
| 1 | PICK & FEED |
| 2 | A-PRINT Y |
| 3 | B-PRINT M |
| 4 | REWIND |
| 5 | A-PRINT C |
| 6 | B-PRINT L |
| 7 | EJECT |

FIG. 3

THERMAL PRINTER WITH TWO PRINT HEADS

FIELD OF THE INVENTION

The present invention relates to thermal dye diffusion printers, and more specifically to such printers having a plurality of print heads.

BACKGROUND OF THE INVENTION

A typical thermal printer uses a ribbon with three or four donor patches (cyan, magenta, yellow and optionally clear protective layer laminate). Printing is typically done by a single print head that receives electrical signals while pressed against the donor ribbon and a receiver. Generally, a temporary laminate of donor ribbon and receiver is pulled thru the nip by a capstan roller at a controlled rate so as to minimize speed variations that would result in banding artifacts in the image. At the conclusion of the printing of one color image plane of an image, the print head is raised, the donor ribbon is advanced to align the next donor patch with the receiver, and the receiver is moved to a start-of-printing position. Printing with patches and a single head requires relocating the receiver between each printing step and positioning the next color patch so the each color image plane of information can be transferred in register to the receiver. While effective for good image quality, such a mode of operation is wasteful for productivity since the rewind steps represent a portion of the total printing time.

In recent years there have been dramatic improvements in costs and thru-put of thermal printing of photos. However, there is still a need in the industry for printing faster, with little or no additional investment in printing hardware. Some of the recent improvements in print time are related to system optimization to reduce processing time. However, most of the recent improvements have come from decreasing the line time of the printer, from a modest 5 msec per line down to as little as a 1 msec per line. At short line times such as the latter, fundamental problems in the thermal imaging become major problems. Sticking of the donor to the receiver due to inadequate cooling of the donor materials and asymmetric thermal smear due to build up of heat in the print head are two issues that become significantly problematic.

It is also known in the art to provide 4-headed thermal printers. With this technology, each print head uses an individual supply of single-color donor ribbon, and printing is done in a continuous motion from start to finish. No rewinding of the receiver is required, and printing speed is generally very high because there is only one continuous printing. The ML500 printer sold by Eastman Kodak Company of Rochester, N.Y., U.S.A. is an example of such a 4-headed printer, and U.S. Pat. No. 5,440,328 describes a printer with three heads for a cyan, magenta and yellow (CMY) system. The use of a plurality of heads that print substantially simultaneously eliminates the need to rewind the paper and greatly improves productivity. In these systems, the receiver, usually in the form of a paper web is fed in a serial manner past the plurality of print heads.

However, 4-head thermal printers have a cost disadvantage. The print head and ribbon transport mechanisms such as capstan drives and pressure rollers, represent a large proportion of the cost of the printer. Thus, multiple head printers are inherently more expensive than single head devices. Another disadvantage of 4-head thermal printers is the waste of both donor ribbon and receiver upon startup. With the current architectures and their long paper paths that need to be threaded before a first print is produced, it is very difficult to avoid wasting one length of the entire paper path from the first print head to exit. The wasted length of receiver web can be as long as 12 inches and an equivalent amount of each of the four ribbons in the ML500 printer. On a long print run, where printing is continuous from print to print, this waste is not particularly significant, but if a user were to print only one or two prints in a job, this waste is a very significant portion of the media expense.

FIG. 1 schematically illustrates a printer 8 according to the prior art having four print heads, four donor assemblies and a medium supply feeding receiver medium to each of the print head and donor assemblies. In the embodiment of FIG. 1, the four print heads 10, 12, 14 and 16 are positioned circumferentially about a large drum 18. Print heads 10, 12, 14, and 16 are provided with a donor ribbon 20, 22, 24 and 26, respectively. A receiver web 28 is threaded around drum 18 so as to be between drum 18 and donor ribbons 20, 22, 24 and 26. Receiver web 28 moves clockwise, as viewed in FIG. 1, first past print head 10 where the yellow color image plane record is transferred to first receiver web 28. The magenta color image plane record is transferred to receiver web 28 by print head 12, and the cyan color image plane record is transferred to receiver web 28 at print head 14. At print head 16, a protective lamination layer is transferred in a uniform manner. Receiver web 28 having a completed print formed thereon is then stripped from drum 18.

The design of FIG. 1 simultaneously eliminated the need to rewind receiver web 28 between the printing of color image planes and greatly improved productivity. However, 4-head thermal printers are inherently more expensive to build than are single head devices. They can also be more expensive in operation. Only one print head is energized at a time during print jobs containing only one 4-color image plane image. For print jobs that contain more than a single 4-color image plane image, any of the four print heads 10, 12, 14, and 16 can print simultaneously on separate receiver webs (not shown). In some embodiments of this type of printer a large receiver web leader is required to feed the receiver web through the system. This leads to waste, as the receiver web leader must be trimmed away and discarded.

U.S. Pat. No. 5,841,460 describes a system that circulates a receiver sheet around a circular track to pass by a single print head many times so that overall cycle time can be reduced by eliminating the time required to rewind the receiver medium. Similarly, U.S. Patent Publication No. 2006/0171755 describes a printing system that attempts to achieve a similar result without a recirculating path by using two print heads to record image information on a receiver medium that is passed by the print heads in a reciprocal manner along a substantially flat path. In the '755 publication, the first print head is adapted to print when the medium moves in one direction along the reciprocating path, and the second print head records an image when the receiver medium moves along the other direction along the reciprocating path. Such a system provides reduced printing time as the time period required to rewind the receiver sheet between printing different color image planes is used at least in part for printing. It will be appreciated, however, that systems described in U.S. Pat. No. 5,841,460 and in U.S. Patent Publication No. 2006/0171755 do not reduce the time required to sequentially print any of the color image planes or the protective lamination layer.

Some printers attempt to conserve printing time by using multiple print heads to simultaneously record images on different sides of the same receiver medium see for example, U.S. Patent Publication No. 2006/0158505 which describes such a printer. However, here too, the cycle time required to sequentially print each individual one of the three color image planes or the protective lamination layer is not reduced, instead a dual sided image is created within the same cycle time.

It is an objective of the present invention to provide a thermal dye diffusion printer that simultaneously achieves high productivity, compactness, and relatively low cost.

SUMMARY OF THE INVENTION

In one aspect of the invention a thermal printer is provided for recording a superimposed image on a receiver medium. The thermal printer has a supply of a first donor web having a first donor material thereon; a supply of a second donor web having a second donor material thereon; a first thermal print head adapted to pressure the first donor web against the receiver medium and to selectively apply heat to the first donor web to cause donor material on the first donor web to transfer to the receiver medium in an image wise fashion to form a first image in an image receiving area of the receiver medium; and a second thermal print head adapted to pressure the second donor web against the receiver medium and to selectively apply heat to the second donor web to cause donor material on the second donor web to transfer to the receiver medium in an image wise fashion to form a second image in the image receiving area. A receiver medium transport system is adapted to move receiver medium along a printing path past the first thermal head and then past the second thermal head, with said first thermal print head and said second thermal print head being positioned along said path so that the first thermal print head and the second thermal print head can apply donor material to the receiver medium at least in part simultaneously to form a single superimposed image in the image receiving area. A controller is adapted to cause said first print head to transfer first donor material to form the first image at least in part while said controller causes said second print head to cause transfer of the second donor material to form the second image.

BRIEF DESCRIPTION OF THE DRAWINGS

FIG. 3 is a table listing operational steps of a first mode of operation of the printer of FIG. 2A.

DETAILED DESCRIPTION OF THE INVENTION

Figure 2A:
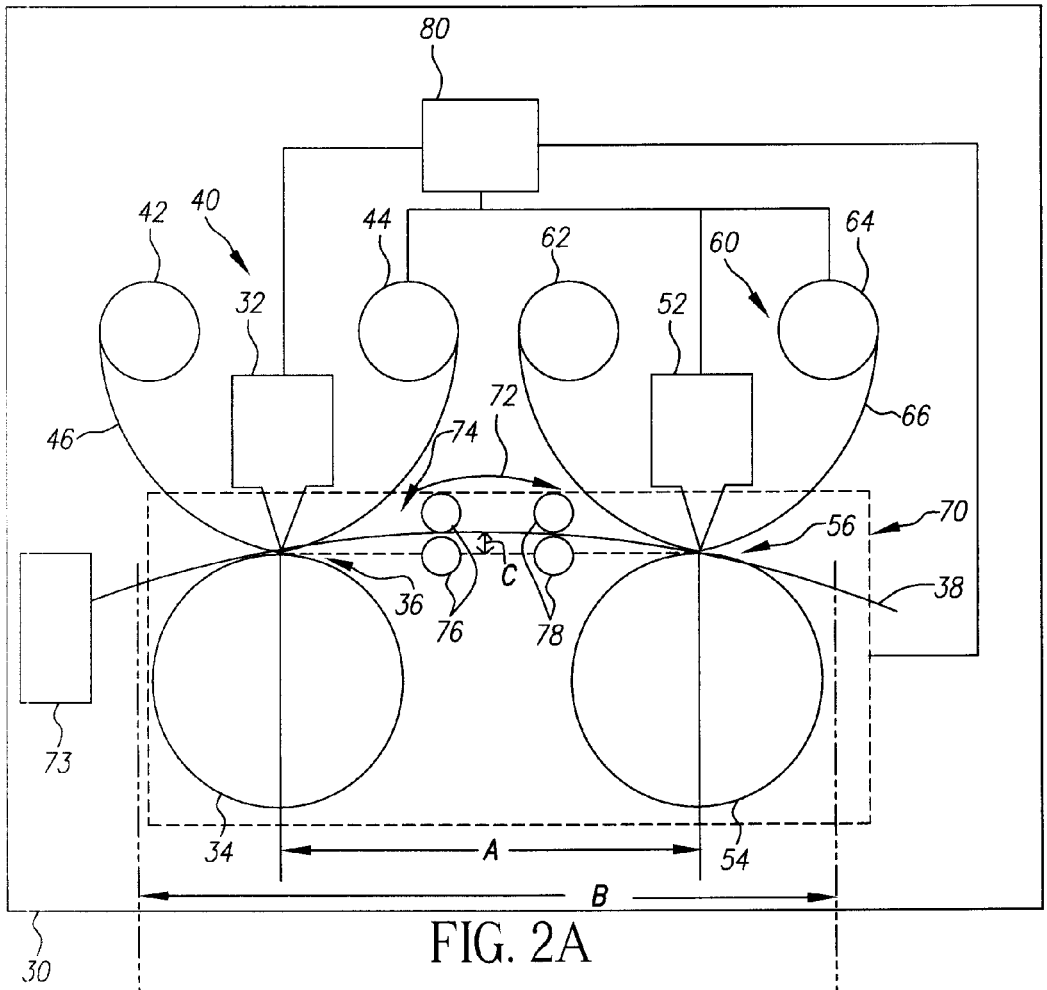
FIG. 2A schematically shows a portion of one embodiment of a printer printing on a receiver medium.
Figure 2B:
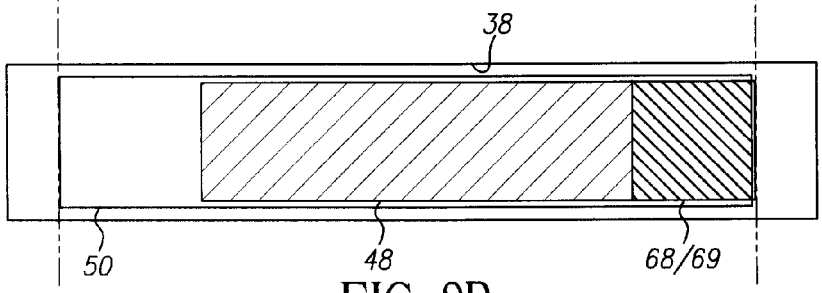
FIG. 2B shows a top view of the receiver medium illustrated in FIG. 2A.

FIG. 2A shows a first illustrative embodiment of a printer 30. As is illustrated in FIG. 2A, printer 30 has a first print head 32 confronting a first platen 34 to form a first nip 36 therebetween. A first donor supply 40 has a first donor supply spool 42 and a first take-up spool 44 with a supply of first donor web 46 disposed between first donor supply spool 42 and first take-up spool 44. First donor web 46 is positioned within first nip 36 so that first print head 32 can apply pressure through first donor web 46 and against a receiver medium 38 supported by first platen 34. During printing, first print head 32 can selectively heat various portions of first donor web 46 so as to occasion the selective transfer of donor material to receiver medium 38 to form a first image 48 in an image receiving area 50 of receiver medium 38 as illustrated in FIG. 2B.

In the embodiment of FIG. 2A, first print head 32 comprises a linear array of resistors that radiate various amounts of heat in proportion to a supplied electrical energy. However, first print head 32 can comprise any other form of thermal print head that can selectively radiate heat to enable donor material to be controllably transferred from first donor web 46 to receiver medium 38. During printing first donor supply 40 causes first donor web 46 to be advanced such that first print head 32 continually confronts unused portions of first donor web 46. This can be done, for example, by using a motor (not shown) to cause first take-up spool 44 to rotate in a manner that draws unused portions of first donor web 46 as required from first donor supply spool 42.

As is also illustrated in FIG. 2A, printer 30 has a second print head 52 confronting a second platen 54 to form a second nip 56 therebetween. A second donor supply 60 has a second donor supply spool 62 and a second take-up spool 64 with a supply of second donor web 66 disposed between second supply spool 62 and second take-up spool 64. Second donor web 66 is positioned within second nip 56 so that second print head 52 can apply pressure through second donor web 66 and against receiver medium 38 supported by second platen 54. During printing, second print head 52 can selectively heat various portions of second donor web 66 so as to occasion selective transfer of donor material to receiver medium 38 to form a second image 68, as illustrated in FIG. 2B, superimposed in registration with first image 48 formed in image receiving area 50. This superimposed printing allows first print head 32 and second print head 52 to record different donor materials in image receiving area 50 to form a second image 68 in image receiving area 50 reflecting a different color image plane than first image 48 to provide a multi-color superimposed image 69 in image receiving area 50, as illustrated in part in FIG. 2B.

In the embodiment of FIG. 2A, second print head 52 comprises a linear array of resistors that radiate various amounts of heat in proportion to a supplied electrical energy. However, second print head 52 can comprise any other form of thermal print head that can selectively radiate heat to enable donor material to be controllably transferred from second donor web 66 to receiver medium 38. During printing, second donor supply 60 causes second donor web 66 to be advanced such that second print head 52 continually confronts unused portions of second donor web 66. This can be done, for example, by using a motor (not shown) to cause second take-up spool 64 to rotate in a manner that draws unused portions of second donor web 66 from second supply spool 62 through second nip 56 as needed to ensure that desired tones are recorded on receiver medium 38.

A receiver medium transport system 70 provides a mechanism for advancing receiver medium 38 along a printing path 72 leading from a receiver supply area 73 and through first nip 36 such that first print head 32 can record the first image 48 on receiver medium 38. Receiver medium transport system 70 further provides sufficient structure and active components, such as controllable motors, solenoids or the like, as may be used to support or guide receiver medium 38 to direct receiver medium 38 from first nip 36 to second nip 56 in order to permit second print head 52 to record the second image 68 on receiver medium 38.

In the embodiment illustrated in FIG. 2A, receiver medium transport system 70 comprises first platen 34 and second platen 54 which are each electrically operable to rotate to move receiver medium 38 along printing path 72, and on an arrangement of guides 76 and 78 that are closely spaced along printing path 72 to support or guide movement of receiver medium 38 from first nip 36 to second nip 56. In this embodiment, guides 76 and 78 take the form of pairs of rollers, however other forms of guides can be used, including, but not limited to, belts, guided platens and the like. Guides 76 and 78 can be passive or electrically operable to urge receiver medium 38 to move along printing path 72.

In other embodiments, receiver medium transport system 70 can comprise any structure known to those of skill in the printing arts for moving a receiver medium along printing path 72.

In the embodiment of FIG. 2A, first print head 32 is provided with a first donor web 46 with alternating patches of cyan and yellow donor material, while second print head 52 is provided with a second donor web 66 with alternating patches of magenta donor material and patches of a clear protective layer laminate or other patches of donor material as desired. As is also illustrated in FIG. 2A, printer 30 has a controller 80 that is connected to and adapted to integrate the operation of first print head 32, second print head 52, first donor supply 40, second donor supply 60. Controller 80 is further adapted to provide signals to receiver medium transport system 70 to control position of receiver medium 38 during printing by way of a connection (not shown) to electrically operable components thereof. During printing, controller 80 acts in a conventional manner to convert data representing an image into image records representing cyan, yellow, magenta and/or clear protective laminate. Controller 80 then causes a superimposed image to be printed on receiver medium 38 by operating first print head 32, first donor supply 40, second print head 52, second donor supply 60, and receiver medium transport system 70 to move receiver medium 38 to transfer donor material according to the image records to form superimposed image 69 in registration on common image receiving area 50 of receiver medium 38.

Referring to FIG. 3, Table 1 provides a timing diagram that can be used by controller 80 when printing multiple images using first print head 32 and second print head 52 of FIG. 2A. In Step 1, controller 80 causes receiver medium 38 to be fed to first print head 32. In the embodiment illustrated in FIGS. 2A and 2B, receiver medium 38 takes the form of a sheet picked from a supply (not shown) and fed to first print head 32 in a conventional manner. Those skilled in the art will understand that receiver medium 38 may be supplied in continuous web form and need not be cut into sheets until after printing.

As receiver medium 38 passes under first print head 32 from left to right, as illustrated in FIG. 2A, controller 80 causes first print head 32 to begin printing by transferring yellow donor material to the yellow color image plane record to receiver web 38 (Step 2). As receiver medium 38 continues in its path from left to right along printing path 72, receiver medium 38 passes through guides 76 and 78 and then begins to pass into second nip 56 wherein second print head 52 can begin recording a second image plane record within image receiving area 50 (Step 3). As is shown in FIG. 2A, first print head 32 is separated from second print head 52 by a distance A that is less than length B of image receiving area 50. This allows controller 80 to cause second print head 52 to begin printing by transferring magenta donor material according to the magenta color image plane record in image receiving area 50 of receiver medium 38 before first print head 32 has completed printing the yellow color image plane record, so that the printing of the first color image plane record (yellow) is done at least in part simultaneously with the printing of the second image plane record (magenta).

After the yellow and the magenta color image planes are complete, controller 80 causes receiver medium 38 to be rewound to the left (Step 4), again reversed and started under first print head 32 for a second pass (Step 5). Controller 80 then causes first print head 32 to record a third, cyan color image plane on receiver medium 38. Controller 80 then causes second print head 52 to cover image receiving area 50 with a protective lamination layer if this option is selected. In Step 7, receiver medium 38 is ejected, or otherwise made available as a completed image and the second-picked sheet continues in its path from left to right exiting the region of second print head 52 (Step 3). The process can be repeated to secure multiple copies of superimposed image 69.

Figure 1:
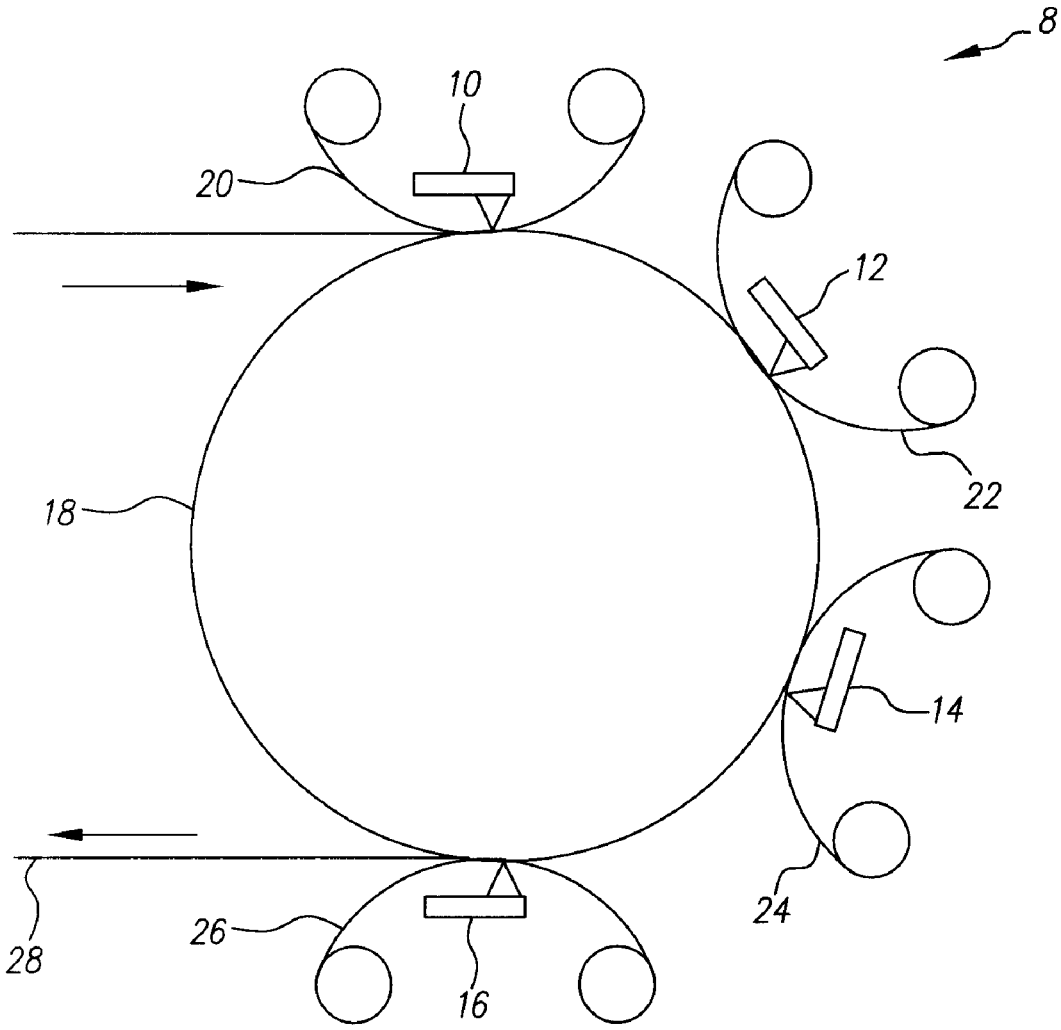
FIG. 1 (Prior Art)
FIG. 1 shows the layout of a printer according to the prior art having four print heads, four donor assemblies and a medium supply feeding receiver medium to each of the print head and donor assemblies.

This design provides high productivity by employing both print heads to apply donor material to some part of superimposed image 69 on receiver medium 38 at the same time since both print heads can apply donor material to the medium at least in part simultaneously to form a single image on the receiver. At the same time, the design minimizes waste as compared to a system that requires a leader such as the prior art construction of FIG. 1.

It will be appreciated that in order to achieve such simultaneous printing it is necessary for second print head 52 to close against and to pressure second donor web 66 against receiver medium 38 while the first color plane is being applied by first print head 32. However, when second print head 52 begins applying pressure against receiver medium 38, the pressure drives receiver medium 38 against second platen 54 which is rotating at a velocity that may be equal to, faster than or slower than a rate of movement of receiver medium 38. When the rate of movement of receiver medium 38 differs from the rate of movement of second platen 54, a shock wave can be induced that travels along receiver medium 38 and releases energy at first print head 32 which can interfere with the printing of first image 48 and, this in turn, can induce unwanted artifacts.

Accordingly, in the embodiment of FIG. 2A, printing path 72 is defined in a manner that allows a portion of receiver medium 38 that is between first print head 32 and second print head 52 to flex as second print head 52 begins to pressure receiver medium 38. Such flexing can continue to an extent C that allows first print head 32 to correctly render first image 48 irrespective of occurrences at second print head 52. For example, in a circumstance where second platen 54 is moving at a greater velocity than receiver medium 38, such flexing can tend to flatten the curvature of receiver medium 38 and in a circumstance where second platen 54 is moving at a lesser velocity than receiver medium 38 such flexing can tend to increase the curvature of receiver medium 38.

In this way, a forward portion of receiver medium 38 can be temporarily slowed or accelerated as a result of being pressured by second print head 52 against second platen while second platen 54 is rotating without substantially interfering with the movement of a trailing portion of receiver medium 38 past first print head 32. This, in turn, reduces the likelihood that the introduction of pressure by second print head 52 will induce the creation of an artifact in the first image plane record.

In the embodiment illustrated in FIG. 2A, the printing path 72 is defined in a way that creates a curvature in receiver medium 38. In particular, in this embodiment, receiver medium transport system 70 uses guides 76 and 78 as a curve inducing structure 74 that urges the receiver medium 38 to travel in a curved manner along the printing path 72 in the region between first print head 32 and second print head 52. This arrangement is useful for preventing receiver medium 38 from acting, even momentarily, as a rigid structure as can occur with certain types or shapes of receiver medium.

This is because such a rigid structure can potentially induce effects at first print head 32 as second print head 52 begins to apply pressure thereto. For example, a shock wave induced at second print head 52 would be immediately transported down the length of a receiver medium 38 by a receiver medium 38 having such a rigid structure. Similarly, any reduction in the velocity of movement of receiver medium 38 caused when second print head 52 applies pressure to receiver medium 38 will be immediately reflected at first print head 32. Thus, it is desirable to prevent the possibility of this by inducing such a curvature.

It will be appreciated that in the above described embodiments, donor patches are referred to as having patches of differently colored donor material and/or clear donor material. However, it will be appreciated that the donor material supplied by the different donor patches can comprise materials that are other than differently colored material and can include, for example, a combination of black donor material and laminate material in a single donor patch, or donor material provided to form layered combinations of such donor material such as may be useful for forming circuits or structures having desired electrical, mechanical, magnetic or optical properties.

The invention has been described in detail with particular reference to certain preferred embodiments thereof, but it will be understood that variations and modifications can be effected within the spirit and scope of the invention.

Parts List

8 prior art printer
10 print head
12 print head
14 print head
16 print head
18 drum
20 donor ribbon
22 donor ribbon
24 donor ribbon
26 donor ribbon
28 receiver web
30 printer
32 first print head
34 first platen
36 first nip
38 receiver web
40 first donor supply
42 first donor supply spool
44 first take-up spool
46 first donor web
48 first image
50 image receiving area
52 second print head
54 second platen
56 second nip
60 second donor supply
62 second donor supply spool
64 second take-up spool
66 second donor web
68 second image
69 superimposed image
70 receiver medium transport system
72 printing path
73 receiver supply area
74 curve inducing structure
76 guide
88 guide
80 controller
A distance separating first print head from second print head
B length of image receiving area
C extent of flexion

The invention claimed is:

1. A thermal printer for recording a superimposed image on a receiver medium, the thermal printer comprising:

a supply of a first donor web having a first donor material thereon;

a supply of a second donor web having a second donor material thereon;

a first thermal print head adapted to pressure the first donor web against the receiver medium and to selectively apply heat to the first donor web to cause donor material on the first donor web to transfer to the receiver medium in an image wise fashion to form a first image in an image receiving area of the receiver medium;

a second thermal print head adapted to pressure the second donor web against the receiver medium and to selectively apply heat to the second donor web to cause donor material on the second donor web to transfer to the receiver medium in an image wise fashion to form a second image in the image receiving area;

a receiver medium transport system adapted to move receiver medium along a printing path past the first thermal head and then past the second thermal head, with said first thermal print head and said second thermal print head being positioned along said path so that the first thermal print head and the second thermal print head can apply donor material to the receiver medium at least in part simultaneously to form a single superimposed image in the image receiving area; and a controller adapted to cause said first print head to transfer first donor material to form the first image at least in part while said controller causes said second print head to cause transfer of the second donor material to form the second image.

2. The printer of claim 1, wherein the receiver medium transport system moves the receiver medium so that the receiver medium can flex in a region between the first print head and the second print head to an extent that allows the first print head to correctly render the first image plane record while the second print head begins the pressuring of the second donor web against the receiver medium to begin forming the second image plane record.

3. A thermal printer as set forth in claim 2, wherein the receiver medium transport path urges the receiver medium to travel in a curved manna along the printing path in the region between first print head and the second print head, so that the receiver medium can flex in a manner that is consistent with the curvature of the receiver medium.

4. A thermal printer as set forth in claim 1, wherein the receiver medium transport path allows the receiver medium to flex within a range of elevations relative to a plane between a first nip between the first print head and a first platen and a second nip between the second print head and a second platen.

5. A thermal printer for recording a superimposed image on a receiver medium, the thermal printer comprising:

a supply of a first donor web having first donor patches and third donor patches;

a supply of a second donor web having second donor patches and fourth donor patches;

a first thermal print head adapted to pressure a first donor material against the receiver medium to image-wise heat the first donor material to selectively transfer donor material from the first donor patch to an image receiving area of the receiver medium and to pressure a second donor material against the receiver medium to image-wise heat a third donor material to selectively transfer donor material from the third donor patch to the image receiving area;

a second thermal print head adapted to image-wise heat the second donor material to selectively transfer a second donor material from the second donor patch to the image receiving area and a fourth donor material from the fourth donor patch to the image receiving area;

a receiver medium transport system adapted to move the receiver medium along a reciprocal path from a start position, along a first direction past said first thermal print head and then past the second thermal print head and further being adapted to move the receiver medium in a second direction past the second thermal print head and then the first print head; and, a controller adapted to integrate the operation of the first thermal print head, the second thermal print head and the receiver medium transport system to cause the receiver medium transport system to move the receiver along the reciprocal path in at least two of the directions and to cause the first print head and second print head to sequentially form a single superimposed image on the medium of a first, a second, a third and a fourth image plane record during said movement.

6. A thermal printer as set forth in claim 5, wherein the receiver medium transport system is adapted to reverse movement of the receiver medium along the path between applying the second image record and the third image record.

7. A thermal printer as set forth in claim 5, wherein the receiver medium is sized to receive only a single superimposed image.

8. A thermal printer as set forth in claim 5, wherein the receiver medium is sized to receive two or more separate superimposed images.

9. A thermal printer as set forth in claim 5, wherein said controller causes recording of the first, second, and third image plane records to be completed before the controller begins printing any images on a second receiver.

10. A thermal printer as set forth in claim 5, wherein said controller causes at least at least two of the first, second, third and fourth image plane records are recorded during a single movement of receiver past the first print head and the second print head.

11. A method for printing recording images on a receiver using a first donor material and a second donor material, the method comprising the steps of:

at a first position, image-wise heating the first donor material to transfer a first image plane record to the receiver;

at a second position, image-wise heating the second donor material to transfer a second image plane record to the receiver; and moving the receiver along a path between said first position and second position, which are positioned relative to each other along said path so that donor material is transferred to the receiver at least in part simultaneously to form a single superimposed image on the receiver of said first and second image plane records.

12. The method of claim 11, further comprising the step of inducing a curve in the receiver medium as the receiver medium travels from the first position to the second position.

13. A method for printing recording images on a receiver using a first donor material having first and third donor patches and a second donor material having second and fourth donor patches; the method comprising the steps of:

at a first position, applying heat in an image-wise fashion the first donor material to selectively transfer a first image plane record from the first donor patch to the receiver and a third image plane record from the third donor patch to the receiver;

at a second position, applying heat in an image-wise fashion to the second donor material to selectively transfer a second image plane record from the second donor patch to the receiver and a fourth image plane record from the fourth donor patch to the receiver; and moving the receiver along a path between said first position and said second position, which are positioned relative to each other along said path so that donor material is transferred to the receiver at least in part simultaneously to form a single superimposed image on the receiver of said first and second image plane records, at least twice to sequentially form a single superimposed image on the medium of said first, second, third and fourth image plane records.

14. A method for printing an image comprising the steps of:

moving a receiver medium along a printing path past a first printing position and a second printing position with said first printing position and said second printing position being separated by a distance that is less than a length of an image receiving area on the receiver medium;

pressuring a first donor web having a first donor material thereon against the image receiving area as the receiver medium passes the first printing position;

selectively heating the first donor web in a manner that transfers first donor material to the receiver medium in an image-wise fashion to form a first image record in the image receiving area;

pressuring a second donor web having a second donor material thereon against the image receiving area as the receiver medium passes the second printing position; and selectively heating the second donor web in a manner that transfers second donor material to the image receiver a medium in an image-wise fashion to form a second image record in the image receiving area in registration with the first image record;

wherein the receiver medium is moved in a manner that allows the receiver medium to flex in a portion of the receiver medium held between the first printing position and the second printing position.

15. The method of claim 14, further comprising the step of inducing a curve in the receiver medium as the receiver medium travels from the first position to the second position.

* * * * *

UNITED STATES PATENT AND TRADEMARK OFFICE

CERTIFICATE OF CORRECTION

PATENT NO. : 7,508,404 B2
APPLICATION NO. : 11/643272
DATED : March 24, 2009
INVENTOR(S) : Richard P. Henzel et al.

It is certified that error appears in the above-identified patent and that said Letters Patent is hereby corrected as shown below:

| | |
|---|---|
| Column 8, line 50 | In Claim 3, delete "manna" and insert -- manner --, therefor. |
| Column 9, line 44 | In Claim 10, after "causes" delete "at least". |

Signed and Sealed this

Fifth Day of January, 2010

David J. Kappos

David J. Kappos
*Director of the United States Patent and Trademark Office*